US005564614A

United States Patent [19]

Yang

[11] Patent Number: 5,564,614

[45] Date of Patent: Oct. 15, 1996

[54] NAILING DEPTH ADJUSTING MECHANISM FOR PNEUMATIC NAIL GUNS

[75] Inventor: Peter Yang, Taichung, Taiwan

[73] Assignee: Testo Industry Corp., Taipei, Taiwan

[21] Appl. No.: 491,049

[22] Filed: Jun. 15, 1995

[51] Int. Cl.[6] ..... B25C 7/00; B25C 1/00

[52] U.S. Cl. ..... 227/142; 227/8

[58] Field of Search ..... 227/8, 142, 156

[56] References Cited

U.S. PATENT DOCUMENTS

| | | | |
|---|---|---|---|
| 4,405,071 | 9/1983 | Austin | 227/8 X |
| 4,767,043 | 8/1988 | Canlas, Jr. | 227/8 |
| 4,821,937 | 4/1989 | Rafferty | 227/142 X |
| 5,197,646 | 3/1993 | Nikolich | 227/8 |
| 5,219,110 | 6/1993 | Mukoyama | 227/8 |
| 5,261,587 | 11/1993 | Robinson | 227/8 |
| 5,385,286 | 1/1995 | Johnson, Jr. | 227/8 |

*Primary Examiner*—Joseph J. Hail, III
*Assistant Examiner*—Jay A. Stelacone
*Attorney, Agent, or Firm*—Donald C. Casey

[57] ABSTRACT

A nailing depth adjusting mechanism for a pneumatic nail gun is described. The mechanism includes a firing control strip fastened to the gun body which releases the firing pin of the pneumatic nail gun. The firing control strip has two parallel lugs and a toothed adjusting wheel disposed between the lugs. The wheel has a longitudinal axially internally threaded hole and holes are provided in the lugs. A safety bar is provided having a threaded rod at one end. The rod is inserted through the lugs and threadedly received in the hole in the adjusting wheel. The end extending from the wheel is received in a socket which, in turn, is received in a hole through one lug. A compression spring is provided between the adjusting wheel and the opposite lug. Rotation of the wheel then displaces the threaded rod within the mechanism and, in turn, moves the safety bar.

1 Claim, 5 Drawing Sheets

NAILING DEPTH ADJUSTING MECHANISM FOR PNEUMATIC NAIL GUNS

BACKGROUND OF THE INVENTION

The present invention relates to a nailing depth adjusting mechanism for adjusting the nailing depth of a pneumatic nail gun.

When operating a pneumatic nail gun, as illustrated in FIG. 1, nails (staples) are loaded in the magazine 16, then the trigger 17 is triggered to deliver one nail from the magazine 16 to the muzzle 18. When adjusting the nailing depth, the cover 12 is opened, and the adjusting mechanism 13 is adjusted to move the safety bar 14 to the desired position. When the position of the safety bar 14 is set, the nailing operation can then be started. When the safety bar 14 is stopped against the workpiece, the actuating bar 15 is moved backwards to trigger a firing control strip inside the gun body 11, causing the firing pin to strike the nail, and therefore the nail is driven into the workpiece. As shown in FIG. 2, when the cover 12 is opened, the stop plate 132 is forced away from the adjusting wheel 131 by the oval coupling portion 121 of the cover 12, and therefore the adjusting wheel 131 can be turned to move the safety bar 14 forwards or backwards. When set, the cover 12 is closed. When the cover 12 is closed, the stop plate 132 returns to its former position to stop the adjusting wheel 131 from rotation. This structure of nailing depth adjusting mechanism is inconvenient to operate and difficult to maintain.

SUMMARY OF THE INVENTION

The present invention has been accomplished to provide a nailing depth adjusting mechanism for pneumatic nail guns which eliminates the aforesaid drawbacks. It is one object of the present invention to provide a nailing depth adjusting mechanism for pneumatic nail guns which is convenient to operate. It is another object of the present invention to provide a nailing depth adjusting mechanism for pneumatic nail guns which is easy to maintain. To achieve these objects, there is provided a nailing depth adjusting mechanism comprised of a firing control strip fastened to the gun body of a pneumatic nail gun and driven to release the firing pin of the pneumatic nail gun, the firing control strip has two parallel lugs, and toothed adjusting wheel disposed between the lugs and having a longitudinal internally threaded hole. A safety bar forced to move the firing control strip in releasing the firing pin of the pneumatic nail gun is provided. The safety bar has a threaded rod at one end inserted through the lugs and threaded into the threaded hole on the toothed adjusting wheel. A socket is mounted in one lug on the firing control strip and receives the end of the threaded rod of the safety bar, and a coil spring is mounted in a recess in the adjusting wheel surrounding the threaded rod and is compressed between the adjusting wheel and one lug of the firing control strip.

DETAILED DESCRIPTION OF THE PREFERRED EMBODIMENT

Figure 1:
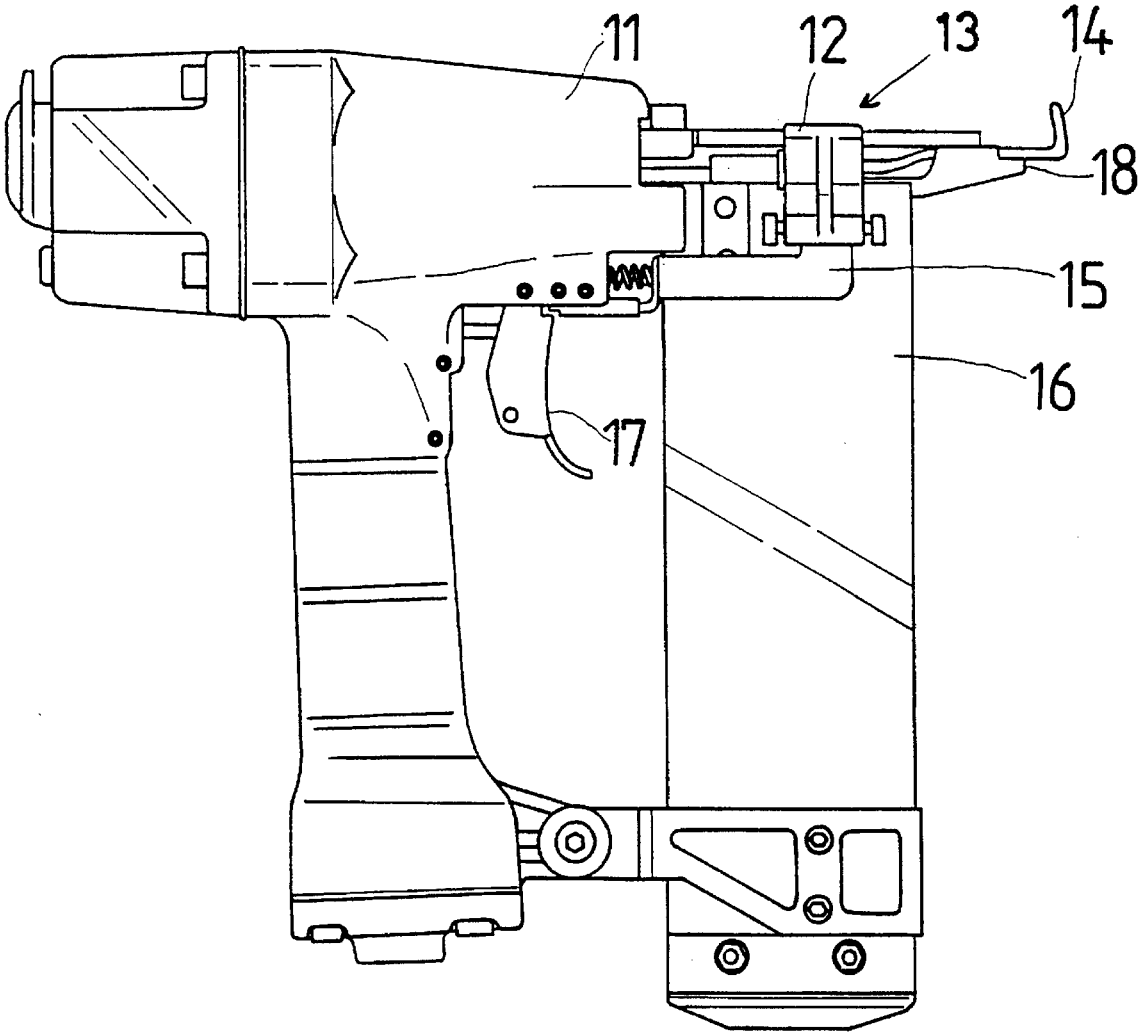
FIG. 1 (PRIOR ART)
FIG. 1 shows a pneumatic nail gun according to the prior art.
Figure 2A:
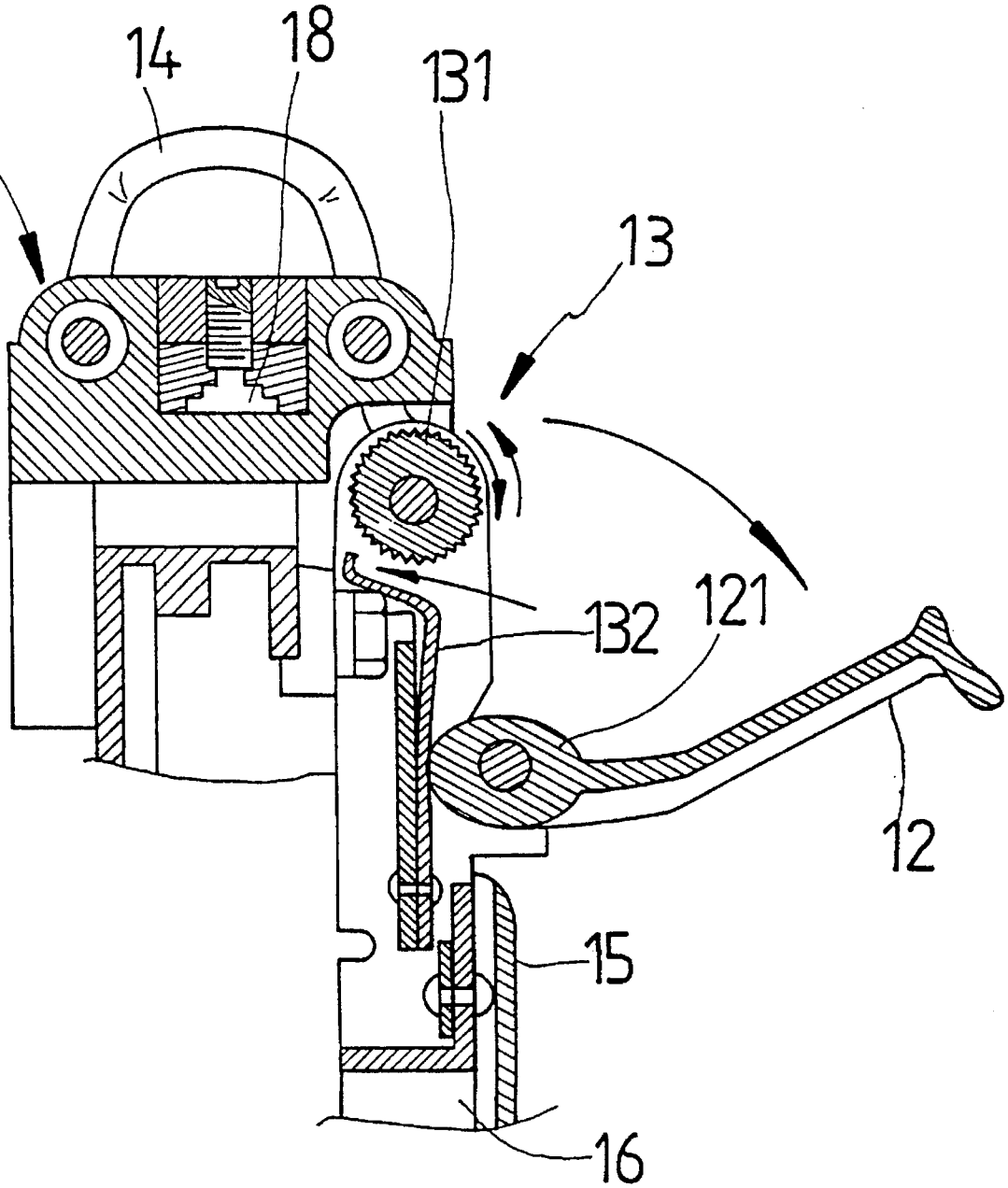
FIG. 2A (PRIOR ART)
FIG. 2A is a sectional view in an enlarged scale taken on a part of FIG. 1, showing the cover opened, the stop plate disengaged from the adjusting wheel, and the adjusting wheel rotated according to the prior art.
Figure 2B:
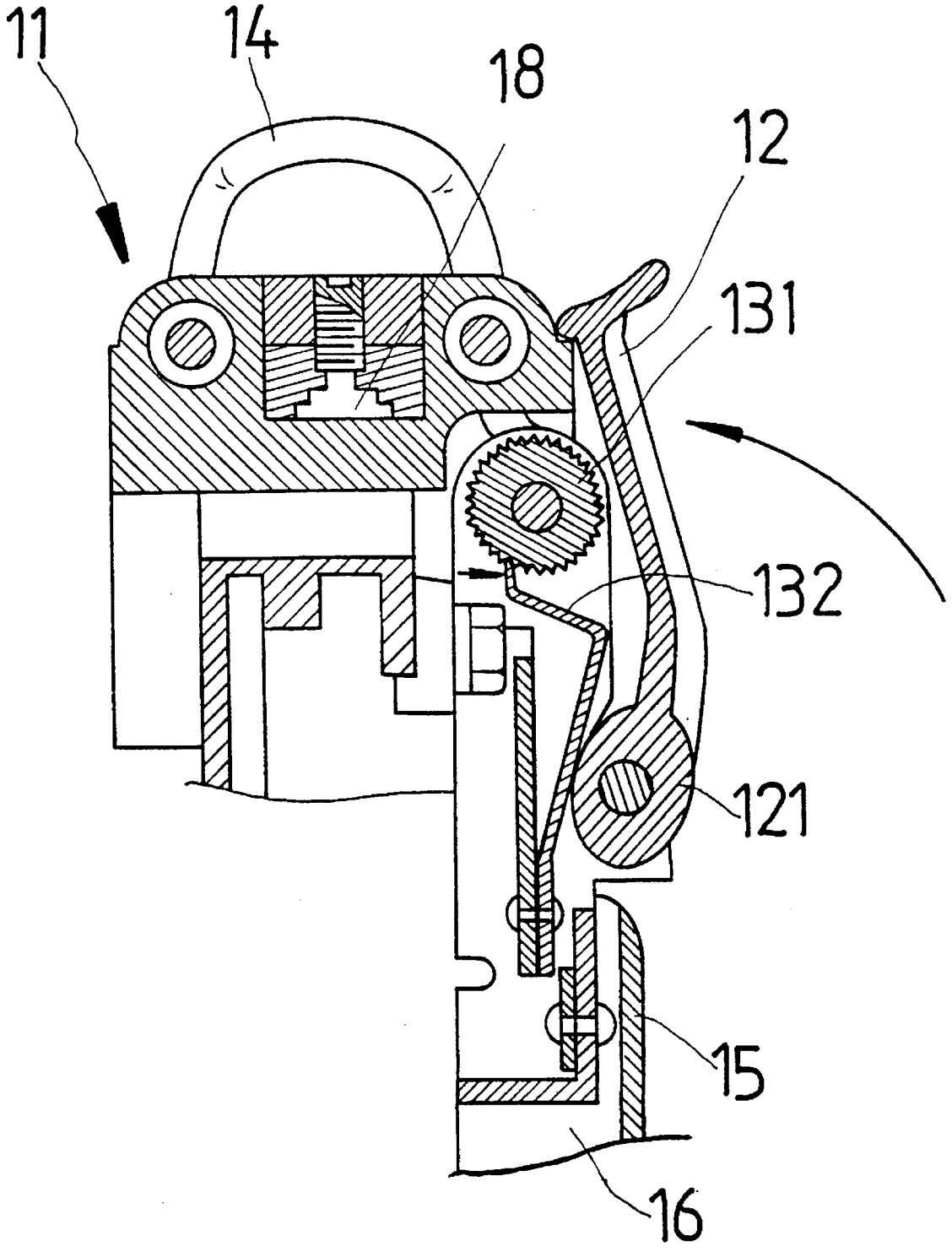
FIG. 2B (PRIOR ART)
FIG. 2B is similar to FIG. 2A but showing the cover closed and the stop plate engaged with the adjusting wheel.
Figure 3:
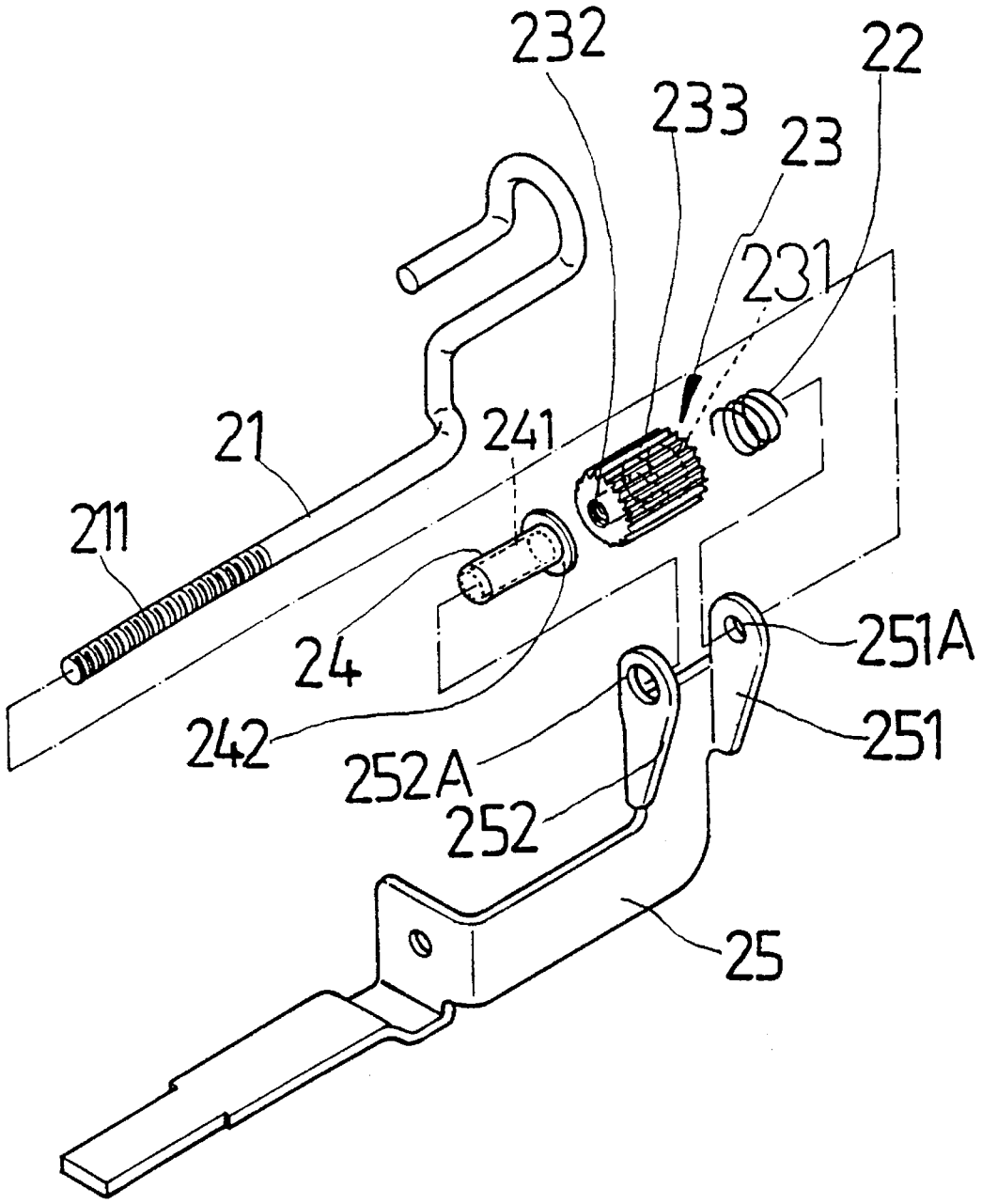
FIG. 3 is an exploded view of a nailing depth adjusting mechanism according to the present invention.

Referring to FIG. 3, a nailing depth adjusting mechanism for pneumatic nail guns in accordance with the present invention comprises a safety bar 21, a coil spring 22, an adjusting wheel 23, a socket 24, and a firing control strip 25. The safety bar 21 has a rear end terminating in a screw rod 211. The adjusting wheel 23 has a toothed portion 233 around the periphery, a bore 231 at one end, and a screw hole 232 at an opposite end. The socket 24 has a longitudinal center hole 241, and an outward flange 242 at one end. The firing control strip 25 has two parallel lugs at one end, namely, the first lug 251 and the second lug 252. The first lug 251 has a hole 251A. The second lug 252 has a hole 252A corresponding to the hole 251A on the first lug 251. The holes 251A and 252A are of different diameters.

Figure 4:
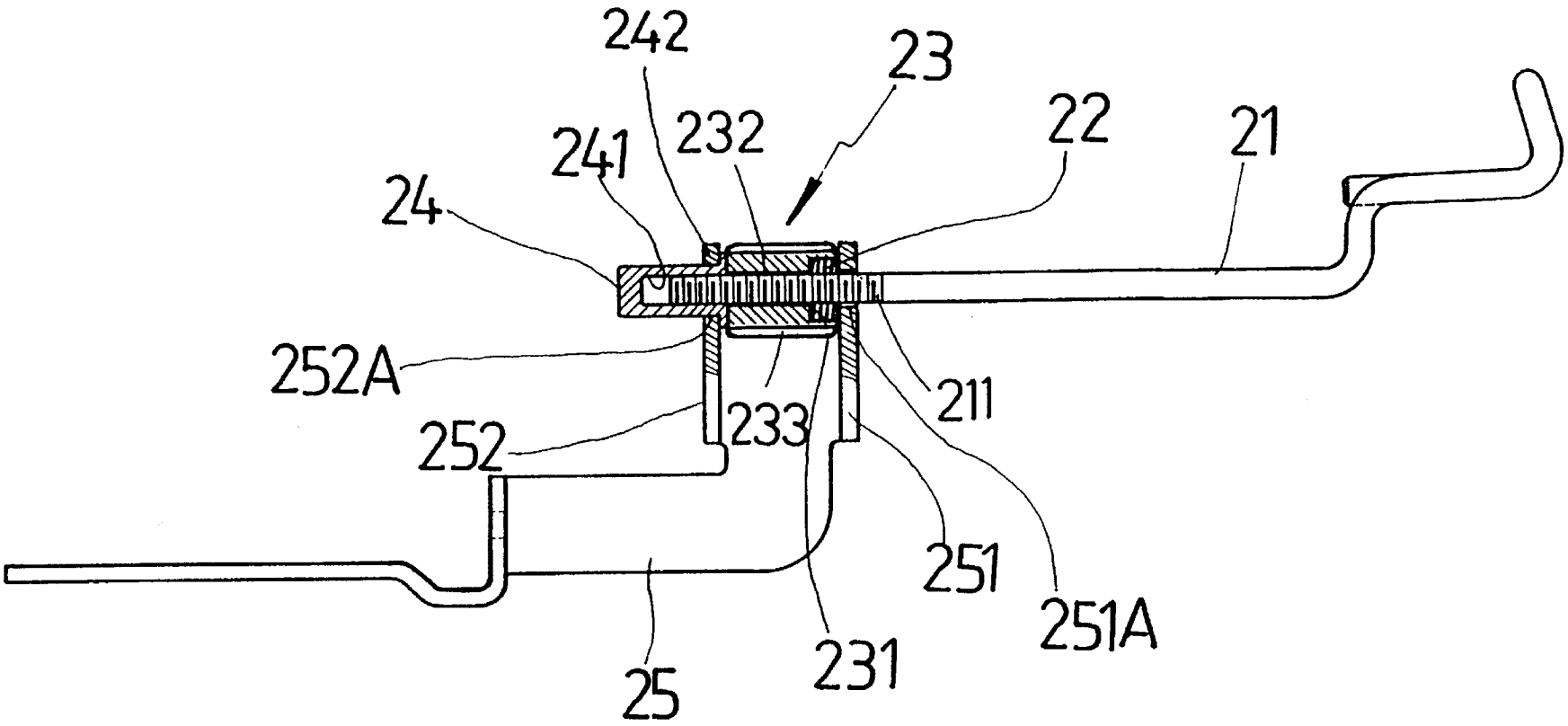
FIG. 4 is an assembly plain view of the nailing depth adjusting mechanism shown in FIG. 3.

Referring to FIG. 4, the socket 24 is inserted through the hole 252A on the second lug 252 with its outward flange 241 stopped at the second lug 252 and facing the first lug 251, the coil spring 22 is mounted within the bore 231, the screw rod 211 of the safety bar 21 is inserted through the hole 251A on the first lug 251 and the coil spring 22 in the bore 231 of the adjusting wheel 23 and threaded into the screw hole 232 of the adjusting wheel 23 and then into the longitudinal center hole 241 of the socket 24. The firing control strip 25 is fastened to the gun body of the pneumatic nail gun (not shown). When assembled, the adjusting wheel 23 has one end stopped against the outward flange 242 of the socket 24, and an opposite end stopped against the first lug 251 by the coil spring 231. As the socket 24 is covered on the rear end of the screw rod 211 of the safety bar 21, the safety bar 21 can be smoothly moved forwards and backwards by rotating the adjusting wheel 23. Furthermore, when a nail is driven into the workpiece, the coil spring 22 absorbs shocks from the safety bar 21.

I claim:

1. A nailing depth adjusting mechanism for a pneumatic nail gun, comprising:

a firing control strip fastened to the pneumatic nail gun said firing control strip comprising a first lug and a second lug disposed in parallel at one end thereof, a first hole on said first lug and a second hole on said second lug being axially aligned;

a socket extending through said second lug hole, having an outwardly extending flange at one end abutting said second lug and facing said first lug;

an adjusting wheel disposed between the outward flange of said socket and said first lug, said adjusting wheel having an axial internally threaded hole therethrough and a toothed outer surface;

a safety bar having a threaded rod at one end extending through said first hole on said first lug and threadedly received in the hole on said adjusting wheel and further extending into said socket; and a coil spring mounted around said safety bar and disposed between said adjusting wheel and said first lug whereby rotation of said wheel will displace said rod axially along the hole therein.

* * * * *